US007694434B2

(12) United States Patent
Lee

(10) Patent No.: US 7,694,434 B2
(45) **Date of Patent: *Apr. 13, 2010**

(54) LAUNDRY DRIER

(75) Inventor: Soon Jo Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 544 days.

This patent is subject to a terminal disclaimer.

(21) Appl. No.: 11/390,310

(22) Filed: Mar. 28, 2006

(65) Prior Publication Data

US 2006/0218817 A1 Oct. 5, 2006

(30) Foreign Application Priority Data

Mar. 31, 2005 (KR) ..... 10-2005-0026936

(51) Int. Cl.
*F26B 11/02* (2006.01)

(52) U.S. Cl. ..... 34/607

(58) Field of Classification Search ..... 34/601, 34/604, 602, 606, 607
See application file for complete search history.

(56) References Cited

U.S. PATENT DOCUMENTS 2,389,433 A * 11/1945 Hough ..... 34/87
2,460,422 A * 2/1949 Koppel ..... 34/606
2,498,172 A * 2/1950 Mintner et al. ..... 432/107
2,503,330 A * 4/1950 Geldhof ..... 432/117
2,619,737 A * 12/1952 Geldhof et al. ..... 34/604
2,635,354 A * 4/1953 Geldhof et al. ..... 34/131
2,675,628 A * 4/1954 O'Neil ..... 34/75
2,694,867 A * 11/1954 Smith ..... 34/605
2,722,751 A * 11/1955 Steward ..... 34/82
2,742,708 A * 4/1956 McCormick ..... 34/76
2,748,496 A * 6/1956 Hellyer ..... 34/603
2,751,688 A * 6/1956 Douglas ..... 34/82
2,813,353 A * 11/1957 McMillan ..... 34/79
2,817,157 A * 12/1957 McCormick ..... 34/82
2,834,121 A * 5/1958 Geldhof ..... 34/75
2,843,945 A * 7/1958 Whyte ..... 34/82
2,858,688 A * 11/1958 Smith ..... 68/20
2,861,355 A * 11/1958 Douglas ..... 34/82
2,864,249 A * 12/1958 Nichols ..... 68/19
2,866,273 A * 12/1958 Geldhof ..... 34/75
2,873,537 A * 2/1959 Gray, Jr. et al. ..... 34/75
2,875,996 A * 3/1959 Hullar ..... 432/67
2,884,710 A * 5/1959 Smith ..... 34/601
2,886,901 A * 5/1959 Whyte et al. ..... 34/601
2,892,335 A * 6/1959 Gray, Jr. ..... 68/16
2,893,135 A * 7/1959 Smith ..... 34/610
2,925,663 A * 2/1960 Smith ..... 34/75
2,958,138 A * 11/1960 Ashby ..... 34/601

(Continued)

*Primary Examiner*—Stephen M. Gravini
(74) *Attorney, Agent, or Firm*—KED & Associates, LLP

(57) ABSTRACT

A laundry drier is provided. The laundry drier includes a base, a drying drum, a front cover, a back cover, a top cover, and side covers. The base includes an air passage in the inside of the base, and at least one discharge port for discharging air that has flowed into the air passage. The drying drum is provided above the base and receives the laundry. The front cover is mounted in front of the drying drum, and the back cover is mounted in the rear side of the drying drum. The top cover is mounted above the drying drum, and the side covers are mounted in the lateral sides of the drying drum and have at least two discharge holes.

6 Claims, 6 Drawing Sheets

U.S. PATENT DOCUMENTS 2,959,044 A * 11/1960 Stone ..... 68/12.15
2,961,863 A * 11/1960 Sulcek ..... 68/20
2,964,851 A * 12/1960 Stelljes et al. ..... 34/82
2,975,623 A * 3/1961 Eichhorn et al. ..... 68/12.15
2,985,966 A * 5/1961 Martin ..... 34/75
3,029,525 A * 4/1962 Pinder ..... 34/75
3,039,285 A * 6/1962 Smith ..... 68/19.2
3,040,440 A * 6/1962 Mellinger et al. ..... 34/75
3,050,974 A * 8/1962 Smith ..... 68/20
3,087,351 A * 4/1963 Ross ..... 74/368
3,102,008 A * 8/1963 Pansing et al. ..... 34/79
3,121,000 A * 2/1964 Hubbard ..... 34/75
3,155,462 A * 11/1964 Erickson et al. ..... 34/82
3,263,343 A * 8/1966 Loos ..... 34/82
3,333,346 A * 8/1967 Brucken ..... 34/131
3,409,997 A * 11/1968 Krolzick et al. ..... 34/601
3,509,640 A * 5/1970 Davis et al. ..... 34/601
3,555,701 A * 1/1971 Hubbard ..... 34/602
3,570,138 A * 3/1971 Douglas et al. ..... 34/601
3,789,514 A * 2/1974 Faust et al. ..... 34/82
3,805,404 A * 4/1974 Gould ..... 34/75
3,859,004 A * 1/1975 Condit ..... 34/75
3,959,891 A * 6/1976 Burkall ..... 34/82
4,207,056 A * 6/1980 Bowley ..... 432/3
4,621,438 A * 11/1986 Lanciaux ..... 34/77
4,669,199 A * 6/1987 Clawson et al. ..... 34/82
4,689,896 A * 9/1987 Narang ..... 34/82
4,753,018 A * 6/1988 Golichowski ..... 34/603
4,875,298 A * 10/1989 Wright ..... 34/86
4,891,892 A * 1/1990 Narang ..... 34/86
4,989,347 A * 2/1991 Kretchman ..... 34/607
6,829,845 B2 * 12/2004 Han et al. ..... 34/603
6,931,759 B2 * 8/2005 Jeong et al. ..... 34/485
6,935,048 B2 * 8/2005 Park et al. ..... 34/132
6,954,995 B2 * 10/2005 Kitamura et al. ..... 34/597
7,069,669 B2 * 7/2006 Park et al. ..... 34/603
7,093,377 B2 * 8/2006 Doh et al. ..... 34/596
7,406,780 B2 * 8/2008 Doh et al. ..... 34/606
2004/0010936 A1 * 1/2004 Han ..... 34/595
2004/0123487 A1 * 7/2004 Han ..... 34/595
2004/0123488 A1 * 7/2004 Han ..... 34/595
2004/0134093 A1 * 7/2004 Han ..... 34/595
2004/0163276 A1 * 8/2004 Han et al. ..... 34/603
2004/0216326 A1 * 11/2004 Kitamura et al. ..... 34/597
2005/0132603 A1 * 6/2005 Jeong et al. ..... 34/603
2005/0166421 A1 * 8/2005 Doh et al. ..... 34/603
2006/0086001 A1 * 4/2006 Jeong et al. ..... 34/606
2006/0150439 A1 * 7/2006 Latack et al. ..... 34/601
2006/0218817 A1 * 10/2006 Lee ..... 34/604
2006/0236560 A1 * 10/2006 Doh et al. ..... 34/596
2006/0254082 A1 * 11/2006 Kim ..... 34/595
2007/0227030 A1 * 10/2007 Oh et al. ..... 34/60
2008/0141558 A1 * 6/2008 Bae et al. ..... 34/595
2008/0235978 A1 * 10/2008 Epstein ..... 34/82
2009/0170048 A1 * 7/2009 Kim ..... 432/219

* cited by examiner

LAUNDRY DRIER

BACKGROUND OF THE INVENTION

1. Field of the Invention

The present invention relates to a drier, and more particularly, to a laundry drier capable of reducing manufacturing costs and simplifying an assembling process by allowing one side cabinet to be compatibly used for a left cabinet and a right cabinet, simultaneously.

2. Description of the Related Art

A drum drier is an electronic appliance for receiving wet laundry in the inside of a drying drum and drying the laundry by circulating dry air in the inside of the drying drum.

In detail, the drum dryer is classified into a condensing drier that dries the laundry received in a drying drum by circulating air between the drying drum and a heater, and an exhaust drier where air flows into the drier, and is heated by a heater, flows into a drying drum to dry the laundry, and is then discharged to the outside.

In more detail, in the case of the exhaust drier, air heated while passing through the heater flows into the drying drum and fluff contained in the air is filtered while the air that has flowed into the drying drum passes through a lint filter mounted in front of the drying drum. Also, the air that has passed through the lint filter is discharged to an indoor along an exhaust duct formed in the lower end of the drier.

A related art laundry drier includes a cabinet mounted on its exterior in order to make an appearance elegant and protect the drying drum and various parts mounted in the inside of the drier. In detail, the cabinet includes a front cover and a back cover mounted in the front and back sides of the drying drum, respectively, to support the drying drum, and side covers mounted in both lateral sides of the drying drum. Also, a discharge port is formed in a predetermined location in the inside of the side covers to discharge humid air that has passed through the drying drum to an indoor. Also, the discharge port may be generally formed in the lower rear side of the side covers.

However, since a side cover mounted in a related art laundry drier is formed to have only one discharge port in the lower rear end of the side cover, a left side cover and a right side cover should be manufactured separately. For example, when the right side cover having a discharge port in the lower rear end is mounted in the left side, the discharge port is positioned at the lower front end, which does not match with a discharge port formed in the lateral side of a base.

Therefore, since the left and right side covers should be separately manufactured, manufacturing costs increase.

SUMMARY OF THE INVENTION

Accordingly, the present invention is directed to a laundry drier that substantially obviates one or more problems due to limitations and disadvantages of the related art.

An object of the present invention is to provide a laundry drier capable of reducing manufacturing costs by allowing one kind of side cover to be compatibly used as a left side cover or a right side cover.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a laundry drier including: a base having an air passage formed in an inside of the base, and at least one discharge port for discharging air that has flowed into the air passage; a drying drum provided above the base to receive the laundry; a front cover mounted in front of the drying drum; a back cover mounted in the rear side of the drying drum; a top cover mounted above the drying drum; and side covers mounted in the lateral sides of the drying drum and having at least two discharge holes.

In another aspect of the present invention, there is provided a laundry drier including: a drying drum for receiving the laundry; a base provided below the drying drum and having discharge ports formed in both sides of the base, for discharging air that has flowed from the drying drum; and a cabinet provided on the exterior of the drying drum, wherein the cabinet includes a top cover mounted above the drying drum, a front cover and a back cover mounted on the front and rear sides of the drying drum, respectively, and two side covers mounted on the lateral sides of the drying drum and having at least two discharge holes.

In a further another aspect of the present invention, there is provided a laundry drier including: a drying drum; a base having an air passage for air discharged from the drying drum, and at least one side discharge port for discharging air that has flowed into the air passage; a front cover mounted in front of the drying drum; a back cover mounted on the rear side of the drying drum; a top cover mounted above the drying drum; and two side covers mounted on both lateral sides of the drying drum, having cabinet bead recessed toward the inside of each of the side covers, and two or more discharge holes, at least one of the discharge holes communicating with the side discharge port.

According to the present invention, one kind side cover may be simultaneously used for the left and right side cabinets, which reduces manufacturing costs and simplifies an assembly process.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. However, the present invention should not be construed as being limited to those preferred embodiments set forth herein, and it will be understood by those skilled in the art that addition, modification, and deletion of another element may be made without departing from the spirit and scope of the present invention.

Figure 1:
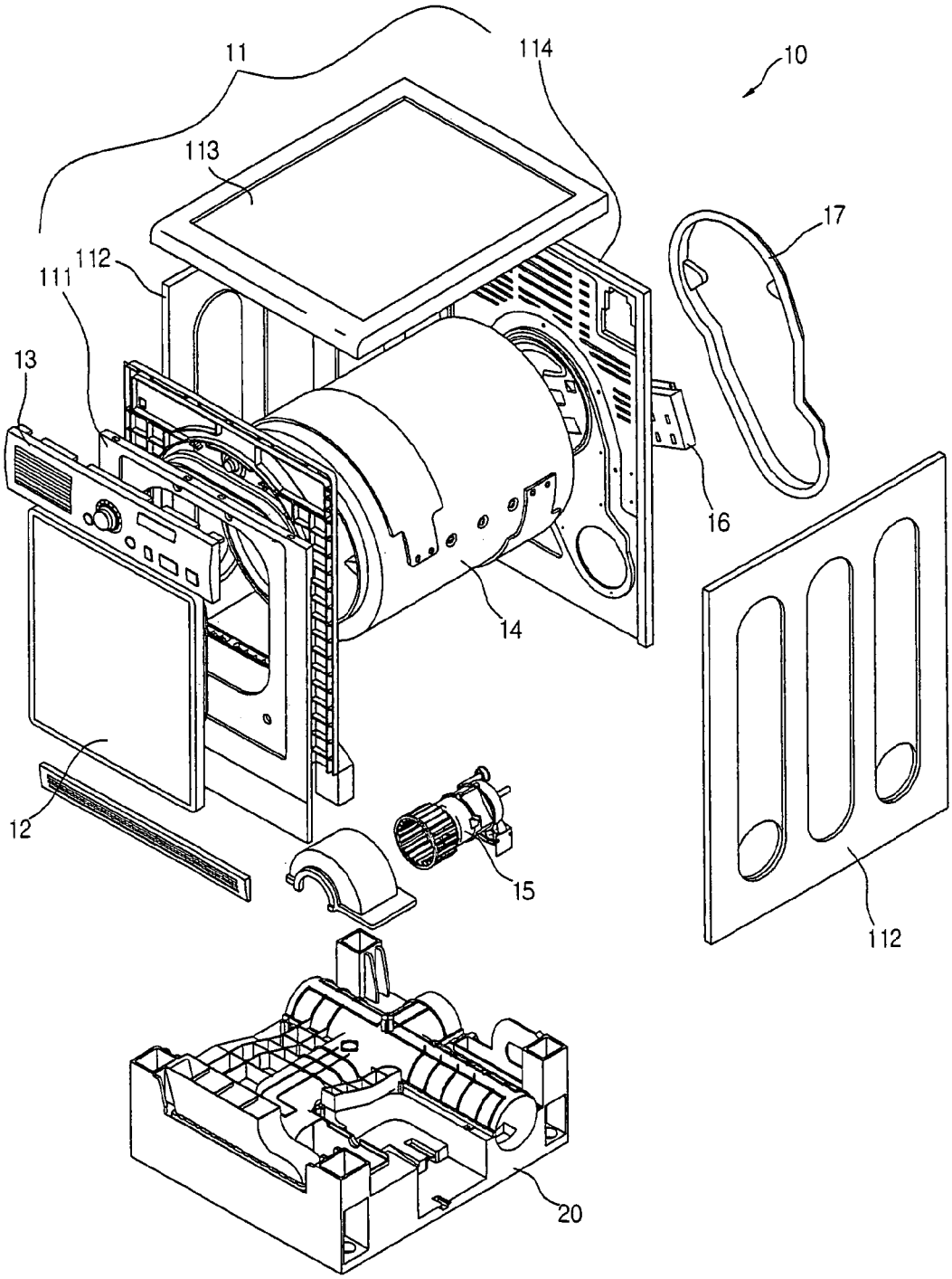
FIG. 1 is an exploded perspective view of a laundry drier according to the present invention.

FIG. 1 is an exploded perspective view of a laundry drier according to the present invention.

Referring to FIG. 1, the laundry drier 10 includes: a drying drum 14 for receiving the laundry; a cabinet 11 mounted in the exterior of the drying drum 14 to protect the drying drum 14; a base 20 installed below the drying drum 14 and having an air passage for discharged air formed in the inside of the base; and a motor 15 seated on the base 20 to rotate the drying drum 14.

In detail, the cabinet 11 includes a front cover 111 for supporting the front side of the drying drum 14, side covers 112 mounted on the left and right sides of the drying drum 14, respectively, a back cover 114 for supporting the rear side of the drying drum 14, and a top cover 113 positioned atop the front, side and rear covers 111, 112 and 114, respectively.

Also, the laundry drier 10 further includes: a door 12 rotatably mounted in the front side of the front cover 111, for opening/closing a front opening of the drying drum 14 so that the laundry is received into the drying drum 14; a control panel 13 mounted on the upper portion of the door 12 and having a drying condition setting button and an operation button; a drying duct 17 mounted on the rear side of the back cover 114 to guide sucked external air to the drying drum; and a heater 16 mounted within the drying duct 17 to heat air sucked from an indoor.

In operation, a user opens the door 12, inserts the laundry into the drying drum 14, and then inputs drying conditions using an input part provided on the control panel 13. When a user presses the operation button, the motor 15 is driven and the heater 16 mounted within the drying duct 17 is heated. Also, a suction blower mounted in the rear side of the base 20 rotates to suck indoor air to the inside of the drier 10.

In detail, the indoor air flows into the drying duct 17 through an external air suction port formed in the lower end of the back cover 114, and is heated to high temperature while passing through the drying duct 17. Also, the indoor air heated to the high temperature flows into the drying drum 14 through a rear wall of the drying drum 14. The high temperature air that has flowed into the drying drum 14 absorbs moisture contained in the laundry to change into a state of high temperature and high humidity. The air that has changed into the state of high temperature and high humidity gets out of the drying drum 14 and filters foreign substances such as fluffs while passing through a lint filter (not shown) formed in the front cover 111.

Also, air that has passed through the lint filter moves along a discharge passage formed in the base 20 and is finally discharged again to the outside of the laundry drier 10, i.e., the indoor.

Figure 2:
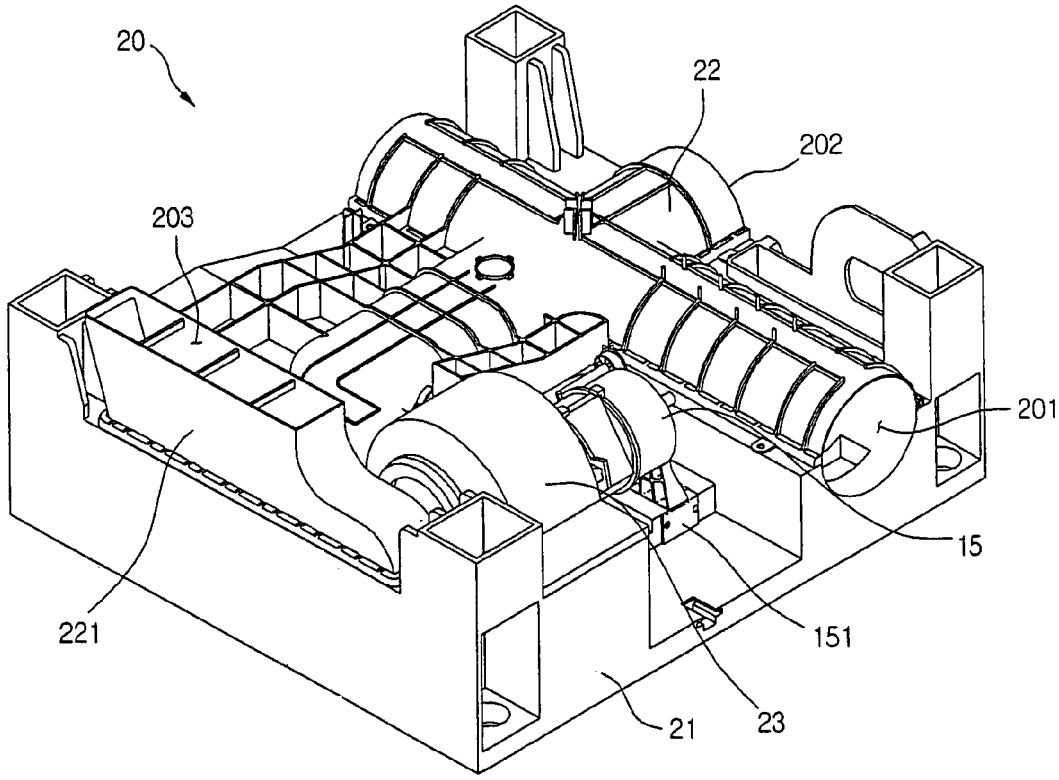
FIG. 2 is a perspective view of a base's appearance mounted in the laundry drier according to the present invention.

FIG. 2 is a perspective view of a base's appearance mounted in the laundry drier according to the present invention.

Referring to FIG. 2, the base 20 mounted in the laundry drier of the present invention includes: a base lower part 21 on which the motor 15 is seated and in the upper inside side of which an air passage for discharged air; and a base upper part 22 for covering the air passage to allow the discharged air to flow in a predetermined direction without being scattered.

In detail, the base lower part 21 and the base upper part 22 are manufactured by plastic injection and coupled to each other together using a fastening member. Also, the base 20 includes a drum connection port 203 formed at a predetermined height on the front side of the base 20, a side discharge port 201 formed in the side of the base 20, and a back discharge port 202 formed in the back of the base 20.

Also, the motor 15 is seated on the upper side portion of the base 20, and a blower is mounted on a rotational shaft of the motor 15 to suck air of the inside of the drying drum. The blower is protected by a blower cover 23.

With the above structure, air in a state of high temperature and high humidity discharged to the front side of the drying drum 14 flows into the drum connection port 203, and is discharged into the indoor through the side discharge port 201 or the back discharge port 202. Here, the air passage formed within the base 20 will be described later in detail with reference to the accompanying drawings.

Figure 3:
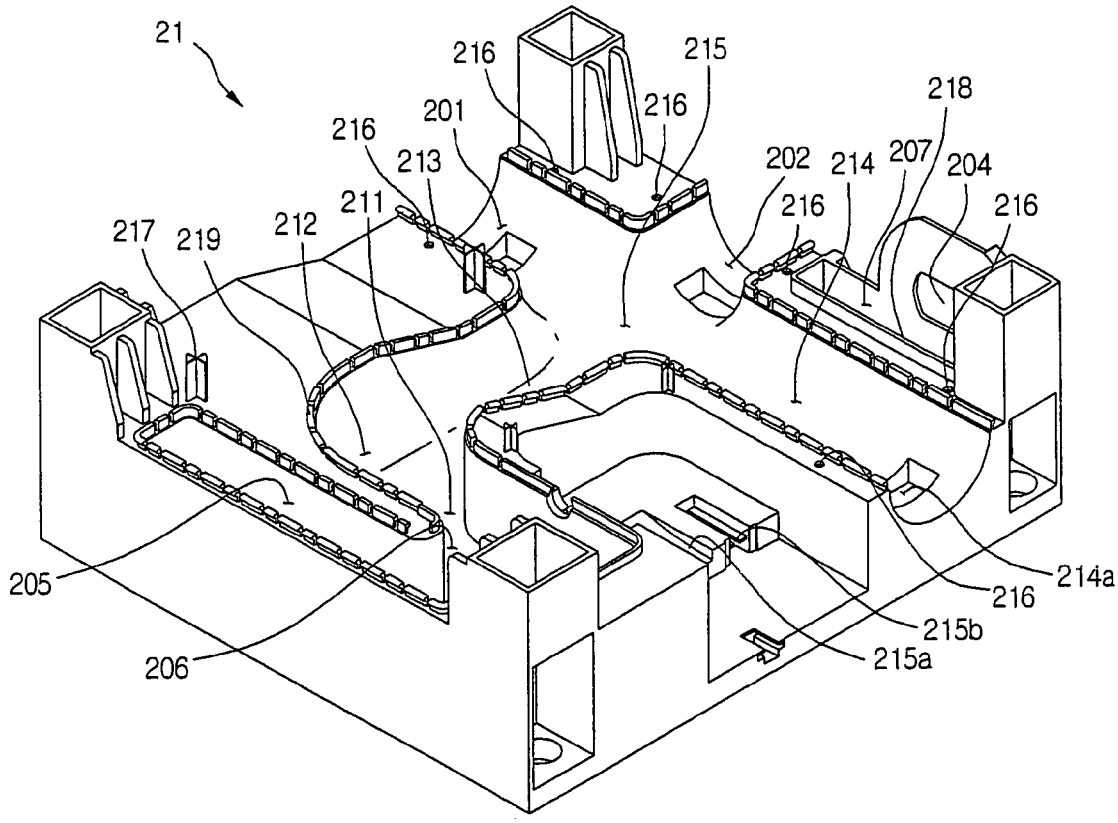
FIG. 3 is a perspective view of a base lower part according to the present invention.

FIG. 3 is a perspective view of the lower part of a base according to the present invention.

Referring to FIG. 3, the base 20 includes the base lower part 21 and the base upper part 22 seated on the base lower part 21 as described above.

In detail, the lower portion of the air passage through which air discharged from the drying drum 14 moves is formed in the upper surface of the base lower part 21. The base upper part 22 is coupled to the base lower part 21 to form a complete air passage.

In more detail, a drum air falling groove 205 to which air that has passed through the drying drum 14 falls is formed in the front side of the base lower part 21. A blower entry 206 serving as a passage through which the air is sucked toward the blower is formed in one side of the drum air falling groove 205. Also, a blower seat 211 on which the blower is seated is formed in the blower entry 206, and an pipe extension 212 curved in a predetermined curvature radius and having an increasing diameter extends from the blower entry 206. Also, a main passage 213 is formed long from a point where the pipe extension 212 terminates to the rear end of the base lower part 21.

Also, a sub-passage 214 is formed in a direction crossing the main passage 213, so that a side discharge port 201 is formed to pass through both sides of the base lower part 21. Also, condensed water falling grooves **214*a* are formed at a predetermined depth in the passages located in the back discharge port 202 and the side discharge port 201 to allow condensed water that is generated while discharged air is condensed to be gathered in the condensed water falling grooves 214*a*. Also, a passage intersecting point 215 where the main passage 213 and the sub-passage 214 intersect is formed to relatively close to the edge of the backside from the central portion of the base lower part 21. That is, the sub-passage 214 is located more closely to the backside than the front side of the base lower part 21**.

Also, at least one guide rib 217 is protruded on the upper surface of the base lower part 21 to allow the base upper part 22 to be guided and properly seated on the base lower part 21. Fastening hooks 219 are protruded at a predetermined height along the edges of the main passage 213 and the sub-passage 214 to allow the base upper part 22 to be closely coupled to the base lower part 21. Also, a plurality of fastening grooves 216 are formed in the upper surface of the base lower part 21 to allow fastening members, by which the base lower part 21 is fastened to the base upper part 22, to pass through the base lower part 21. In detail, the fastening grooves 216 are formed in both corners of the sub-passage 214 and both corners of the main passage 213 to face each other.

Also, an external air suction port 204 is formed in the backside of the base lower part 21 to allow external air into the drying drum through the drying duct 17. Also, a lint inflow prevention groove 207 recessed at a predetermined depth is formed in front of the external air suction port 204 to collect foreign substances such as fluffs contained in indoor air sucked through the external air suction port 204. In detail, a small amount of air having high temperature and high humidity that leaks from a fine gap formed in a coupling portion of the base upper part 22 and the base lower part 21 may be contained in the indoor air flowing into the drying drum through the external air suction port 204. Also, air moving along the passages may contain floating fluffs while passing through the drying drum 14. However, the foreign substances contained in the air sucked through the external air suction port 204 are accumulated in the lint inflow prevention groove 207, which reduces the amount of the foreign substances flowing into the drying duct 17.

A lint inflow prevention threshold 218 is formed long at a predetermined height along the edge of the lint inflow prevention groove 207. In detail, the lint inflow prevention threshold 218 primarily prevents foreign substances that leak from a gap formed at a coupling portion of the base upper part 22 and the base lower part 21. Also, air primarily filtered by the lint inflow prevention threshold 218 is filtered at the lint inflow prevention groove 207.

Also, a motor seat 215*a* for seating the motor 15 thereon, and a motor supporter insert port 215*b* for receiving a motor supporter (not shown) supporting the motor 15, are formed in an inner space located between the blower seat 211 and the sub-passage 214.

With the above structure, air in a high temperature and high humidity state that falls down through the drum air falling groove 205 flows to the blower seat 211 through the blower entry 206. The air that has flowed to the blower seat 211 moves to the main passages 213 along the pipe extension 212. Also, the air that has move to the main passage 213 is scattered at the passage intersecting point 215 and discharged to the indoor through one of the side discharge ports 201 and the back discharge port 202.

Here, only one of the two side discharge ports 201 and the back discharge port 202 is opened by a cap, and the rest two ports may be closed, or all of the discharge ports may be opened by a user's selection. Therefore, when only one discharge port is opened, the air scattered toward closed discharge ports is condensed into water while the air circulates through the passages, and the condensed water is stored in the condensed water falling grooves 214*a*. Also, even when all of the discharge ports are opened, condensed water generated while the air passes through the discharge ports 201 and 202 falls down to the condensed water falling grooves 214*a*.

Figure 4:
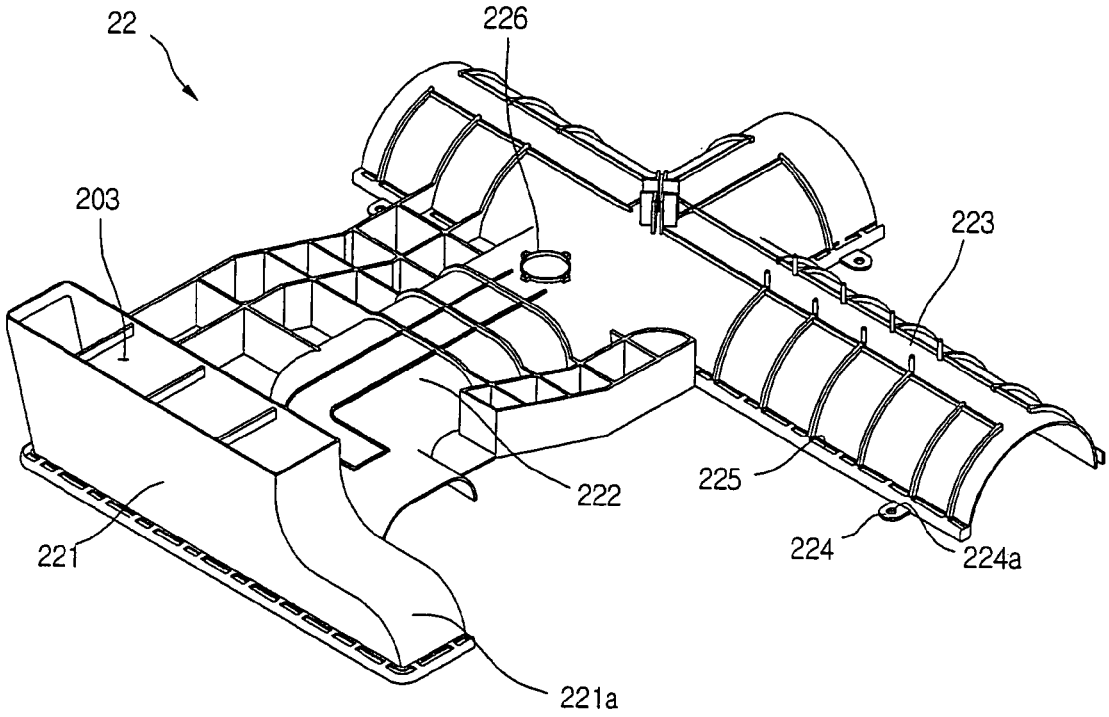
FIG. 4 is a perspective view of a base upper part according to the present invention.

FIG. 4 is a perspective view of a base upper part according to the present invention.

Referring to FIG. 4, the base upper part 22 is seated on the base lower part 21.

In detail, the base upper part 22 has the same shape as that of the passages formed in the upper surface of the base lower part 21 to seal the upper surface of the passages. Also, the drum connection port 203 is formed in the front end of the base upper part 22 to serve as an entry through which air of high temperature and high humidity coming out from the drying drum 14 to the above passages.

In detail, the drum connection port 203 is formed at the upper end of the drum connection duct 221 formed at a predetermined height from the base upper part 22. Also, a blower connection part 221*a* is formed in the side of the drum connection duct 221 to allow the air that descends through the drum connection part 203 to move to the blower entry 206 formed in the base lower part 21.

Also, a main passage cover 222 for covering the pipe extension 212 and the main passage 213 formed in the base lower part 21, and a sub-passage cover 223 for covering the sub-passage 214 are formed in the base upper part 22. The main passage cover 222 and the sub-passage cover 223 mutually intersect. A humidity sensor seat 226 is formed in one point of the main passage cover 222. A humidity sensor is seated on the humidity sensor seat 226 to measure the humidity of air flowing through the main passage 213.

Also, fastening hook inset holes 225 are formed along the lower edges of the main passage cover 222 and the sub-passage cover 223 to receive the fastening hooks 219 formed with a constant interval along the base lower part 21. Also, a fastening elements 224 are formed at both corner ends of the sub-passage cover 223 and the corner ends of the main passage cover 222 to allow the base upper part 22 to be more closely coupled to the base lower part 21. In detail, a fastening member inserted into a fastening hole 224*a* formed in the fastening element 224 is inserted into a corresponding fastening groove 216 formed in the base lower part 21 to more closely couple the base lower part 21 to the base upper part 22. Accordingly, a gap between the base upper part 22 and the base lower part 21 is not generated. That is, the gap between the base upper part 22 and the base lower part 21 is minimized, which prevents air flowing through the passages from leaking and flowing to the external suction port 204.

With the above structure, the air of high temperature and high humidity coming out from the drying drum 14 descends through the drum connection port 203, and flows into the blower entry 206 along the blower connection part 221*a*. The air that has flowed to the blower entry 206 moves along the pipe extension 212, the main passage 213, and the sub-passage 214. The air moving along the main passage 213 and the sub-passage 214 is condensed while moving and discharged to the indoor through the back discharge port 202 and/or the side discharge ports 201.

Figure 5:
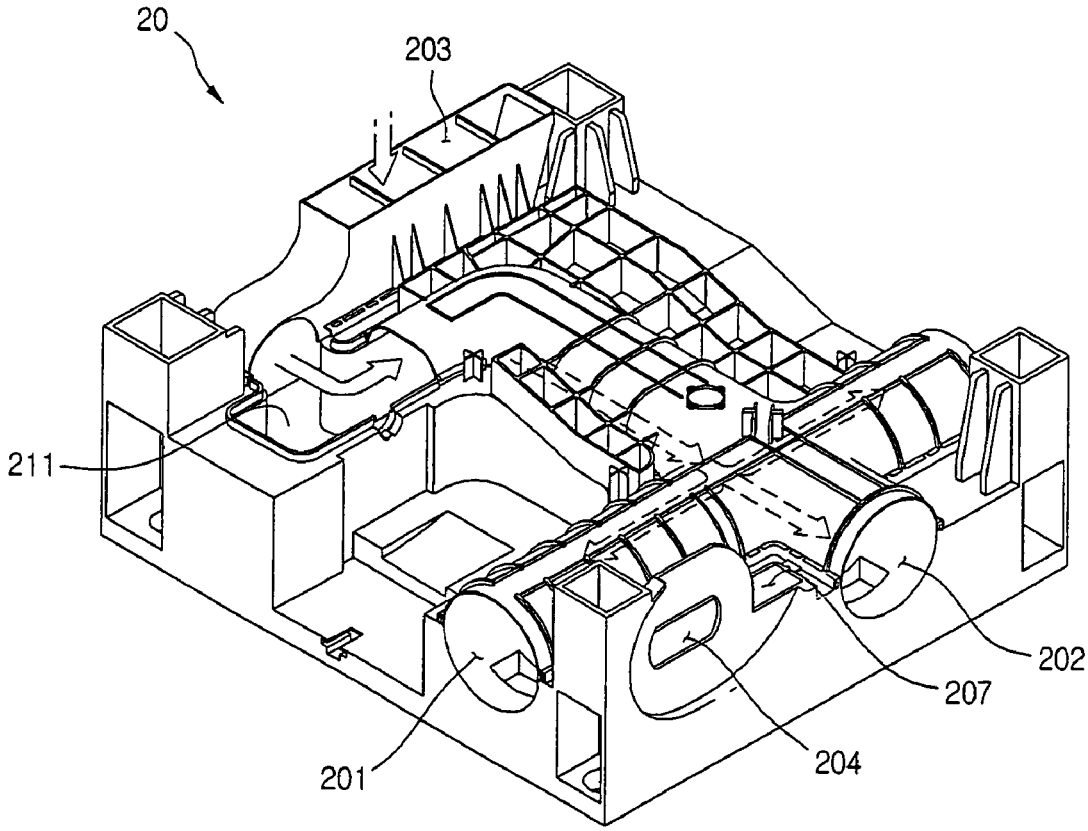
FIG. 5 is a view illustrating air flow moving along the interior of a base according to the present invention.

FIG. 5 is a view illustrating airflow moving along the interior of a base according to the present invention.

Referring to FIG. 5, as described above, the air that has passed through the drying drum 14 is filtered to remove foreign substance contained in the air while passing through the lint filter mounted in the front cover 111, falls down to the drum connection port 203, and then moves the blower entry 206 formed at the end of the blower connection part 221*a*.

Also, the air that has moved to the blower entry 206 changes its flowing direction by the rotating blower seated on the blower seat 211 formed in the end of the blower entry 206. The air that has changed its flowing direction by the blower moves to the pipe extension 212, changes again its flowing direction while moving through the pipe extension 212, and moves to the back of the base 20. Part of the air moving along the main passage 213 is scattered to flow toward the sub-passage 214 at the passage intersecting point 215 where the main passage 213 and the sub-passage 214 intersect. The air scattered to the main passage 213 and the sub-passage 214 is discharged again to the indoor through the back discharge port 202 and/or the side discharge ports 201. Here, while the air of the high temperature and high humidity that comes from the drying drum 14 moves from the drum connection port 203 to the discharge ports 201 and 202, the temperature of the air decreases, which may condense vapor contained in the air into water. Also, the condensed water is collected in the condensed water falling grooves 214*a* formed on the bottom of the main passage 213 and the sub-passage 214.

External air flowing from the backside of the drying drum 14, namely, indoor air having the same temperature and humidity as those of the indoor flows into the laundry drier through the external air suction port 204 formed in the backside of the base 20, and moves into the drying drum 14 along the drying duct 17. Here, the air sucked through the external air suction port 204 is the indoor air existing in the interior of the cabinet 11 of the laundry drier 10. As described above, foreign substances such as fluffs contained in the indoor air sucked through the external air suction port 204 is primarily filtered by the lint inflow prevention threshold 218 and the lint inflow prevention groove 207.

Figure 6:
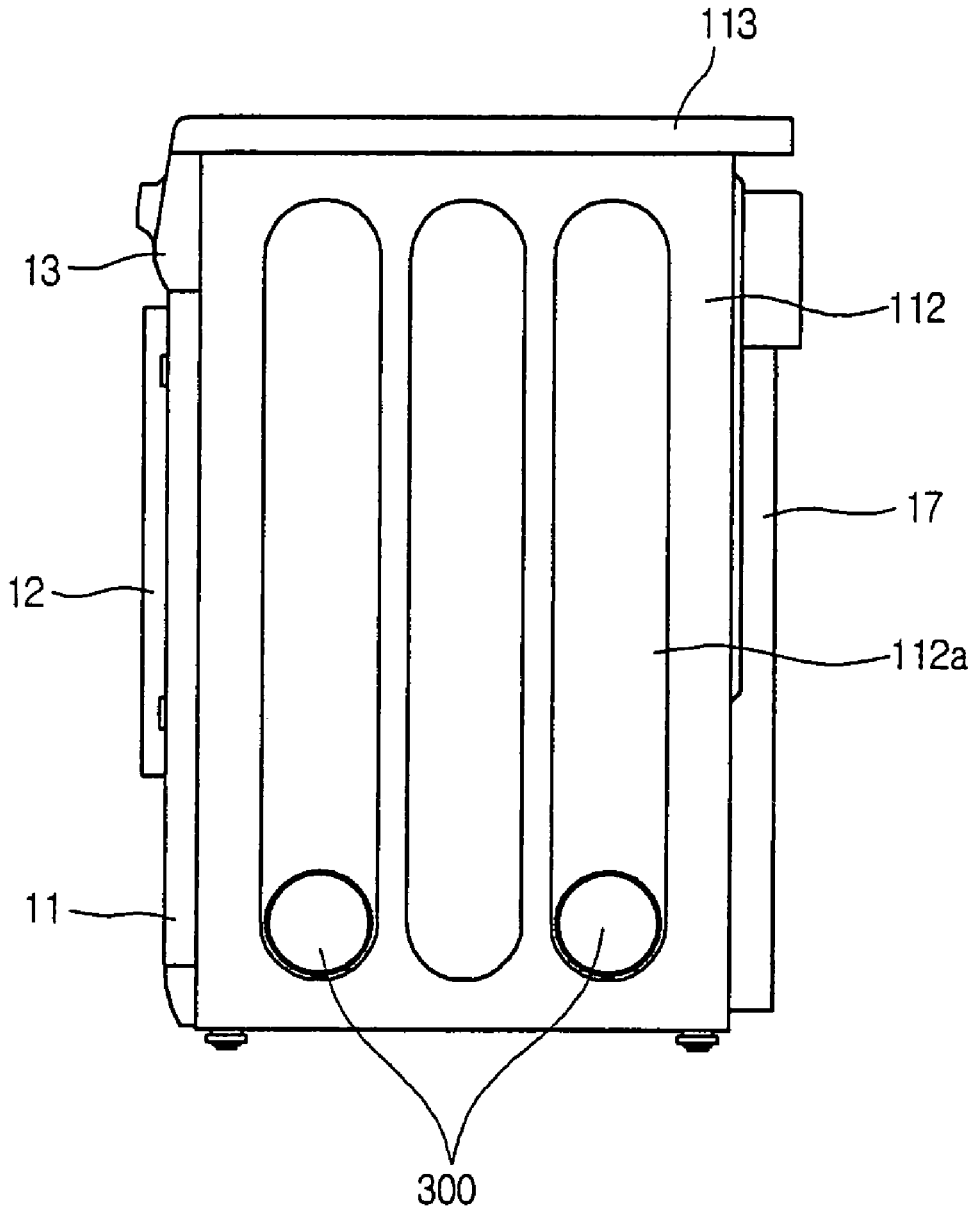
FIG. 6 is a side view of a laundry drier in which side covers are mounted according to the present invention.

FIG. 6 is a side view of a laundry drier in which side covers are mounted according to the present invention.

Referring to FIG. 6, the laundry drier 10 surrounds the exterior of the drying drum 14 using the cabinet 11 in order to protect the drying drum 14.

In detail, the cabinet 11 includes the side covers 112 mounted on the lateral sides of the drying drum 14. In more detail, at least one cabinet bead 112*a* is vertically recessed toward the inside of one of the side covers 112 with a predetermined interval. Each of the upper end and the lower end of the cabinet bead 112*a* is curved with a predetermined curvature radius.

A circular discharge hole 300 having the same radius as the curvature radius of the curved portion formed at vertical both ends of the cabinet bead 112*a* is formed in the lower end of the cabinet bead 112*a*.

Here, two discharge holes 300 are formed in the front and rear sides of each of the side covers 112, respectively, and symmetrically formed with respect to a vertical line passing through the center of each of the side covers 112. Also, the discharge hole 300 is formed in a position corresponding to each of the side discharge ports 201 formed in the base 20.

Therefore, even when one of the side covers 112 is mounted on the left or right side, one of the discharge holes 300 matches with one of the side discharge ports 201 of the base 20.

Since the discharge holes 300 are symmetrically formed in the front and rear sides of each of the side covers 112, so that each of the side covers 112 may be compatibly used for the left or right side of the laundry drier 10. That is, one kind of side cover 10 may be compatibly assembled on the left and right sides of the laundry drier 10 without separately manufacturing a left side cover and a right side cover.

When the side covers 112 according to the present invention are assembled on the left and right sides of the laundry drier 10, four discharge holes 300 are formed. Therefore, the discharge holes 300 that match with the side discharge ports 201 are opened, and the rest two or three discharge holes 300 are closed using a separate cap (not shown) sealing the discharge holes 300.

According to the present invention, one kind of side cover may be compatibly used as the left and right side covers of the laundry drier, which reduces manufacturing costs and simplifies the assembling process of the laundry drier.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dryer, comprising:

a drum provided in a cabinet; and a base coupled to a lower end of the cabinet, wherein the base comprises:

a drum connection duct positioned adjacent an exhaust outlet of the drum, wherein the drum connection duct directs exhaust air from the drum toward the base;

a blower entry that draws the exhaust air through the drum connection duct and into a main passage; and an intersection portion positioned at an end of the main passage, wherein the intersection portion directs air into at least one of a left sub-passage that extends toward at least one of two discharge holes formed in a left side of the cabinet, a right sub-passage that extends toward at least one of two discharge holes formed in a right side of the cabinet, or a rear sub-passage that extends towards a discharge hole formed in a rear side of the cabinet.

2. The dryer of claim 1, wherein the cabinet comprises:

a front cover provided at a front of the drum;

a rear cover provided at a rear of the drum;

a top cover provided at a top of the drum; and left and right side covers provided at left and right lateral sides of the drum, respectively, wherein one of the two discharge holes formed in the left side cover is in communication with the left sub-passage, and one of the two discharge holes formed in the right side cover is in communication with the right sub-passage.

3. The dryer of claim 2, wherein the other of the two discharge holes formed in the left side cover is not in communication with the left sub-passage and is capped, and the other of the two discharge holes formed in the right side cover is not in communication with the right sub-passage and is capped.

4. The dryer of claim 2, wherein the left and right side covers are physically interchangeable such that either of the side covers can be installed on either of the left or right lateral sides of the drum.

5. The dryer of claim 2, wherein each of the side covers includes two beads that extend vertically along each side cover such that the two beads are symmetrically formed on opposite sides of a vertical line that equally divides each side cover, and wherein the two discharge holes formed in each cover are formed in lower ends of the two beads.

6. The dryer of claim 5, wherein the lower ends of each bead has a predetermined radius of curvature that corresponds to a radius of the discharge hole formed therein.

* * * * *